United States Patent [19]

Nakada et al.

[11] 4,416,327

[45] Nov. 22, 1983

[54] CASING FOR AN INTERIOR UNIT OF A SPLIT TYPE OF AN AIR CONDITIONING APPARATUS

[75] Inventors: Minoru Nakada, Fujishi; Yashiro Shimma, Shimadashi; Osamu Inoue; Sei Suma, both of Fujishi, all of Japan

[73] Assignee: Tokyo Shibaura Denki Kabushiki Kaisha, Kanagawa, Japan

[21] Appl. No.: 195,069

[22] Filed: Oct. 7, 1980

[30] Foreign Application Priority Data

Oct. 13, 1979 [JP] Japan ..... 54-132064

[51] Int. Cl.[3] ..... F24H 3/06; F25D 21/14

[52] U.S. Cl. ..... 165/122; 62/285; 62/262; 98/94 AC

[58] Field of Search ..... 62/262, 285, 404, 298; 98/94 AC; 165/122, 76

[56] References Cited

U.S. PATENT DOCUMENTS 2,629,235 2/1953 Harris ..... 98/94 AC

FOREIGN PATENT DOCUMENTS 306319 8/1971 U.S.S.R. ..... 98/94 AC

*Primary Examiner*—Albert J. Makay
*Assistant Examiner*—Henry Bennett
*Attorney, Agent, or Firm*—Cushman, Darby & Cushman

[57] ABSTRACT

A casing for an interior unit of a split type air conditioner including a one piece, molded fan casing housing an upper wall, a curved rear wall connected to the upper wall, side walls connected to each of upper wall and the curved wall and a separator including a flat portion generally parallel with the upper wall.

6 Claims, 6 Drawing Figures

CASING FOR AN INTERIOR UNIT OF A SPLIT TYPE OF AN AIR CONDITIONING APPARATUS

FIELD OF THE INVENTION

The present invention concerns an integrally molded air conditioner casing for the interior fan unit.

BACKGROUND OF THE PRESENT INVENTION

The present invention relates to casings for interior units of split type air conditioning apparatus.

Split type air conditioning apparatus is constructed with exterior and interior units. The exterior unit includes a compressor for compressing refrigerant and a condenser for condensing the refrigerant while the interior unit includes an evaporator which acts as a heat exchanger for evaporating the refrigerator fed from the exterior unit and a fan for circulating air in the room through the heat exchanger. These units are, of course, interconnected and together complete a refrigerant cycle.

FIG. 1 shows the approach used by the prior art for the formation of the case for the interior portion of air conditioning apparatus. The interior unit is substantially divided into upper and lower compartments by an L-shaped separator. The upper compartment is defined between a top wall, an arcuate rear wall, side walls and a separator and serves as a fan casing. A fan is disposed therein so that it lies along the arcuate rear wall. The configuration of the arcuate rear wall is important for it affects the fan's efficiency and is usually a spiral or scroll. One end of the separator which opposes the arcuate rear wall and one end of the arcuate rear wall adjacent the fan cooperate with the fan to form cross-flow blowers. These are also important for fan efficiency. In such a conventional interior unit, careful adjustment of the relationship between the separator and the arcuate rear wall must be carried out for realizing the desired fan efficiency after assembly of the unit because the arcuate rear wall and the separator are separate pieces. In spite of the ability to adjust these pieces, uniformity of fan efficiency for each assembled interior unit is not always attained.

SUMMARY OF THE INVENTION

The present invention overcomes these problems. In the present invention, a fan casing for the interior unit of a split type air conditioning apparatus which includes a curved rear wall and a separator is integrally molded in one piece. In this manner, adjustment of the relationship between the curved rear wall and the separator for realizing the desired fan efficiency is no longer needed and the same fan efficiency for each interior unit is guaranteed.

BRIEF DESCRIPTION OF THE DRAWINGS

Other objects and advantages of the present invention will be apparent from the following detailed description on the presently preferred exemplary embodiment taken in conjunction with the accompanying drawings, in which.

DETAILED DESCRIPTION OF THE PREFERRED EXEMPLARY EMBODIMENT OF THE PRESENT INVENTION

Figure 1:
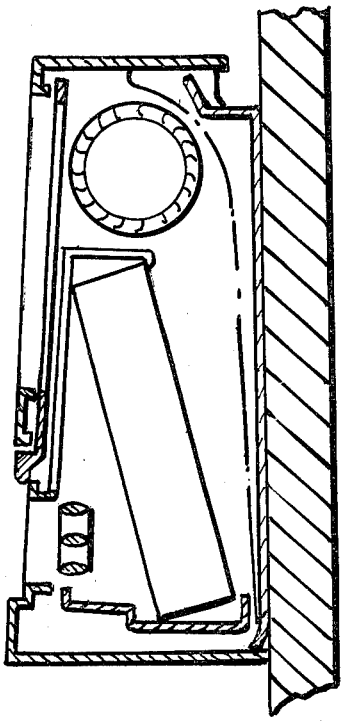
FIG. 1 (PRIOR ART)
FIG. 1 is a cross-sectional view of a conventional, prior art type interior unit for an air conditioner.

As indicated previously, FIG. 1 shows a prior art casing concept where a plurality of separately manufactured casing pieces are joined together and thereafter adjusted to form the fan housing.

Figure 2:
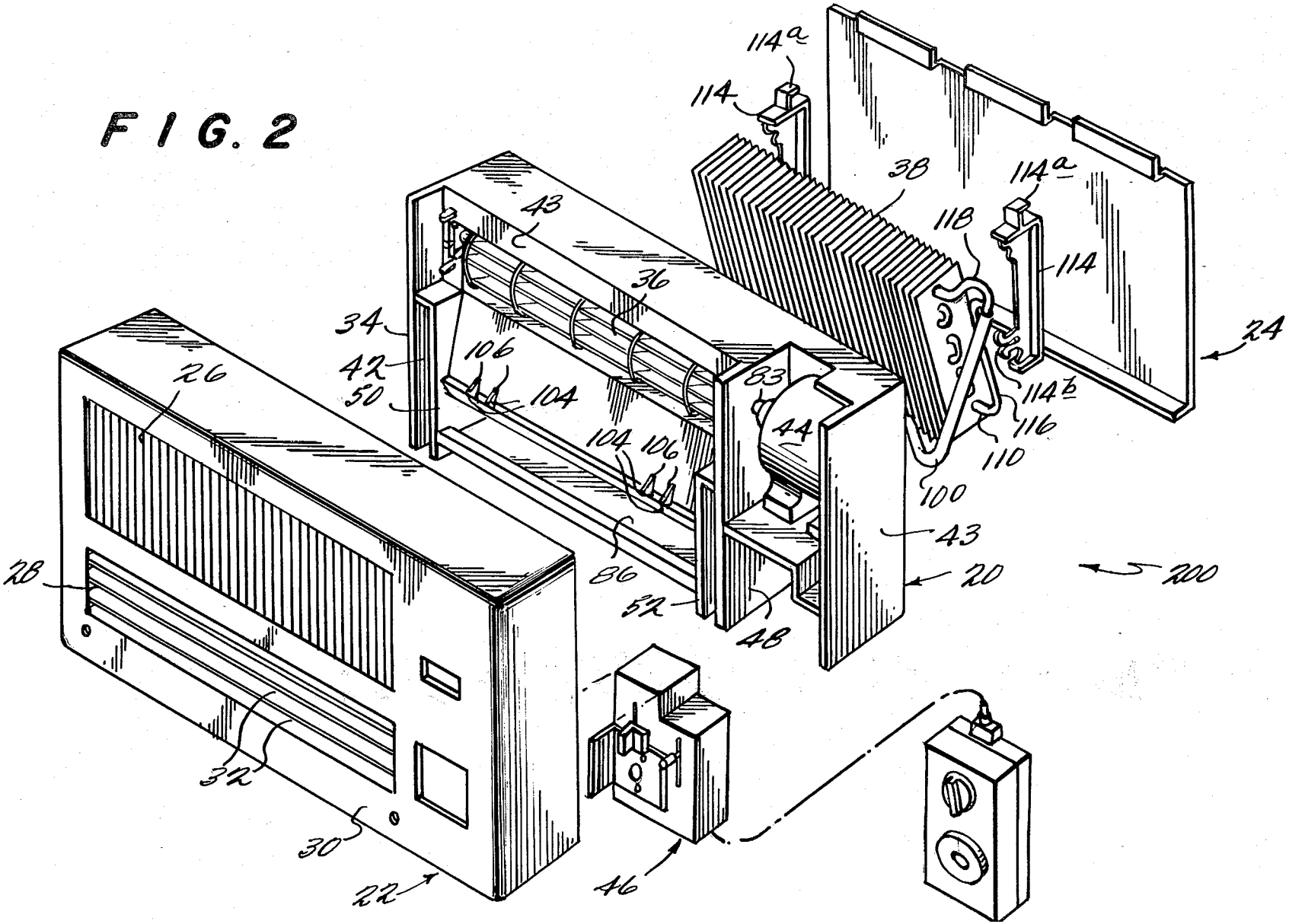
FIG. 2 is an exploded perspective view of an interior unit for a split type air conditioner according to the present invention.

Referring now to FIG. 2, the preferred exemplary embodiment of the present invention is shown.

The interior unit generally indicated at 200 of a split type air conditioner is shown as being comprised of a main blower assembly 20, a front cover 22 and a rear panel 24. The front cover includes a panel member 30 in which an upper grill 26 for taking in air and a lower grill 28 for taking out the air are provided. An air filter (not shown) can be detachably mounted to the cover 22 behind over upper grill 26. A plurality of blades 32 for adjusting the direction of air flow are in parallel arrangement over the lower grill.

The main blower assembly 20 includes a case member 34, in which a cross-flow fan 36 and an evaporator 38 which acts as a heat exchanger, are disposed. Case member 34 is an integrally molded structure and is molded from a variety of moldable resins or plastics.

Figure 4:
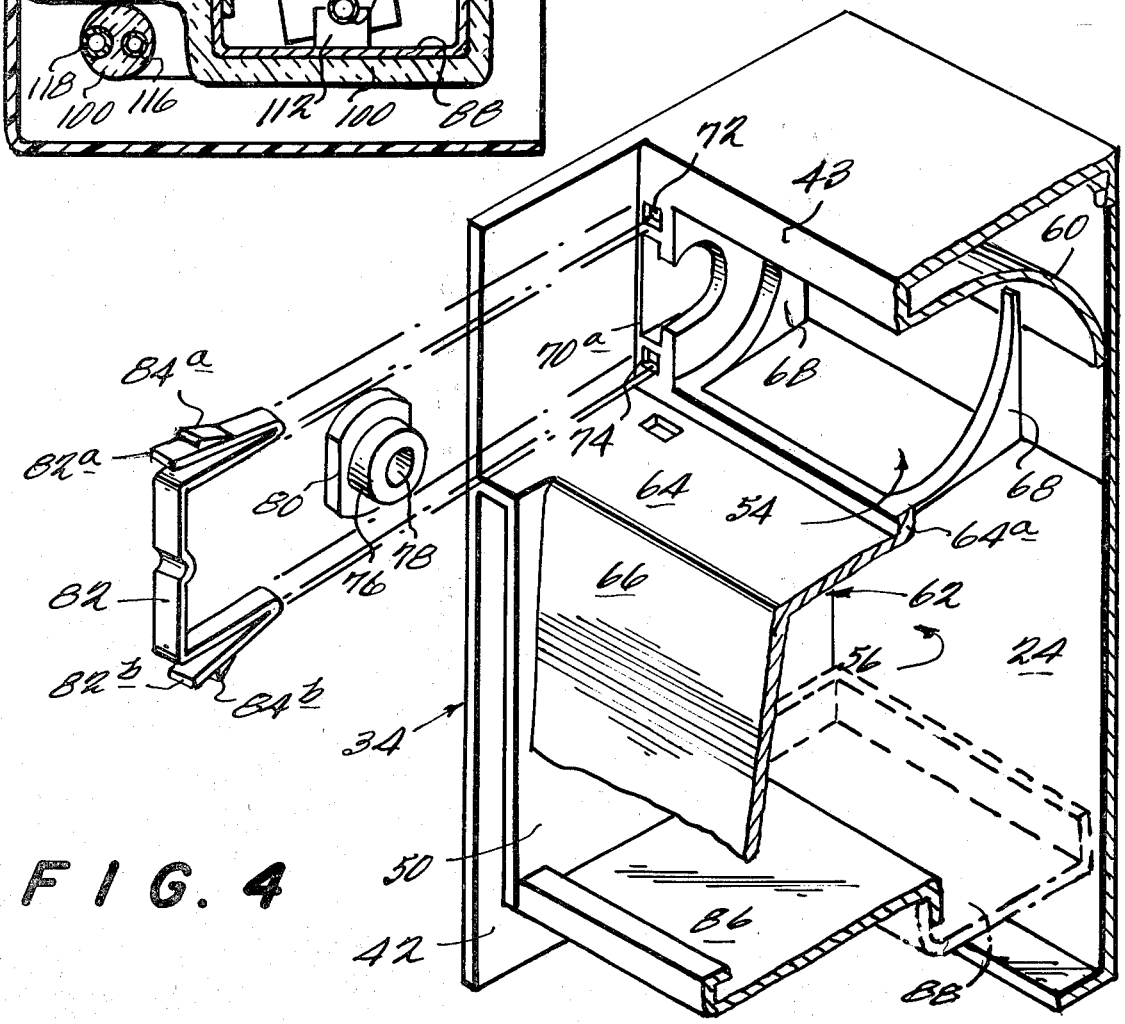
FIG. 4 is a perspective view, partly in vertical section, of the main body of the casing shown in FIG. 2.

Turning now to FIGS. 2 and 4, the latter showing a representative view of one end of the case member, it can be seen that case member 34 is comprised of an upper top wall 40 and side walls 42 and 43 which together form a box like structure. A motor 44, shown in FIG. 2, or other electrical or mechanical parts 46 are housed in an area surrounded by side wall 43 and another interior wall or vertical separator 48. Hereinafter, separator 48 will be referred to as the first separator 48. Double wall portions 50 and 52 are respectively provided on the inside surface of side wall 42 and first separator 48 with wall portions 50 and 52 being spaced from side wall 42 and separator 48 so that an air chamber is defined therebetween.

The area defined between side wall 42 and first separator 48 is divided into an upper chamber 54 and lower chamber 56 by an inverted L-shaped separator 62, hereinafter called the second separator 62. Fan 36 is disposed in the upper chamber 54 and heat exchanger 38 is disposed in the lower chamber 56. Upper chamber 54 constitutes a fan casing with a curved rear wall 60, connected to top wall 40 at a portion 43 facing toward front unit 22, side wall 42, first separator 48 and a second separator 62.

Second separator 62, which extends between side wall 42 and first separator 48, includes an upper flat portion 64 and a depending front flap portion 66. Air taken in through the upper grill 26 and the air filter is prevented from entering the lower chamber 56 by flap portion 66. Instead, air is pulled into the upper chamber 54 by the fan 36. One end of flat portion 64 is bent upwardly as shown at **64*a*, referred to as a nose portion, and extends rearwardly beneath fan 36 in the form of another flat area 67. A plurality of ribs 68 are formed together with separator 62 on the nose portion 64***a* and are spaced apart and extended between the nose portion 64*a* and the curved rear wall 60 so as to support one end of rear wall 60 thereby. Passages 69 lie between ribs 68 for communicating each spaces 54 and 56 therewith. Ribs 68 are formed when case member 34 is molded. Accordingly, the mutual positions between nose portion 64*a* and rear wall 60, and especially side wall 42 where rear wall 60 starts to curve are fixed as previously designed as an integral unit so that fan efficiency can be easily attained and maintained during the life of the apparatus.

A pair of openings 70, including guide slits 70*a* and a pair of holes 72 and 74 on opposite sides of opening 70, are provided on side walls 42 and first separator 48 and these openings are used to attach fan 34 to the casing.

As shown in FIG. 4, a bearing 76 having a central hole 78 with a coaxial flange 80 is inserted in opening 70. Flange 80 is inserted in guide slit 70*a*. A metal clasp 82 of which U-shaped bent blades 82*a* and 82*b* are inserted in holes 72 and 74, respectively, is utilized to fix bearing 76 at side wall 43 and first separator wall 48. Projections 84*a* and 84*b* provided on the outer surface of blades 82*a* and 82*b* secure the insertion of metal clasp 82 in holes 72 and 74. By using a structural metal clasp 82, the U-shaped blades 82*a* and 82*b* serve as plate springs and they absorb the vibration transferred from the shaft of fan 36 (not shown) through bearing 76 during the rotation of fan 36. First separator wall 48 includes an opening 83 for extending one end of the fan shaft therethrough to connect to motor 44.

Figure 5:
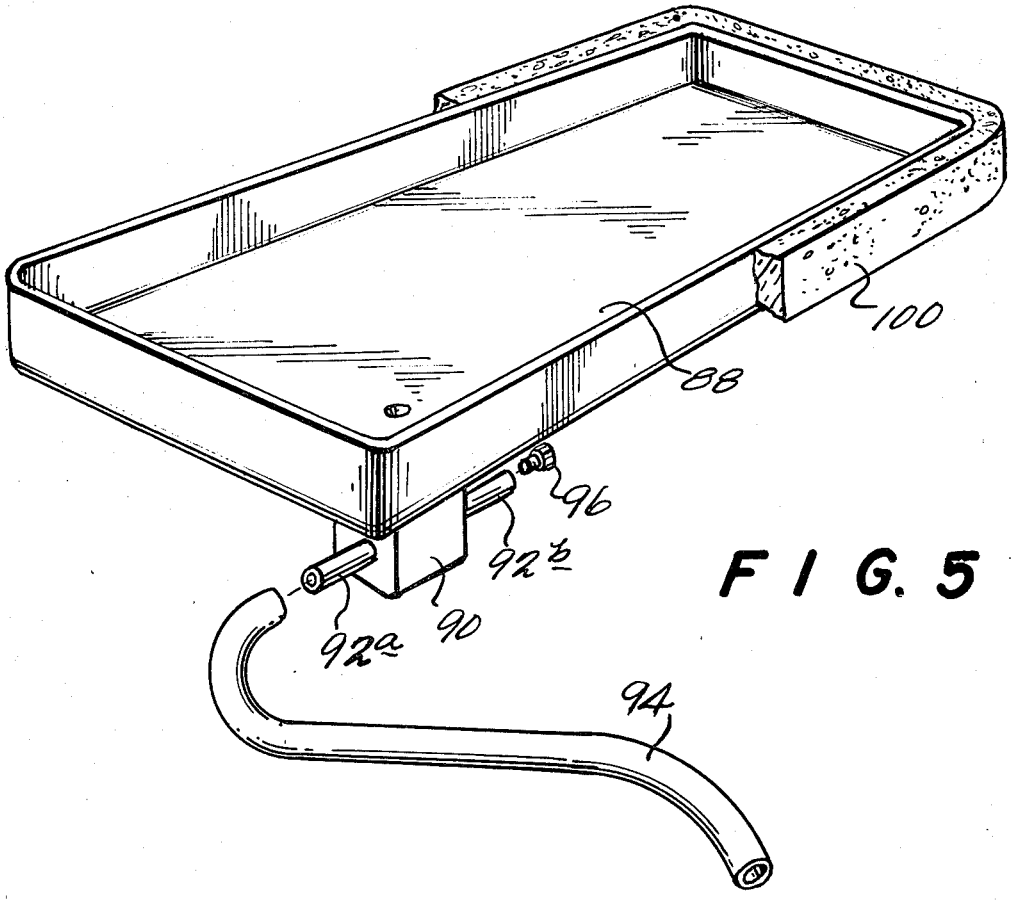
FIG. 5 is a perspective view of a drain pan disposed in the interior unit shown in FIG. 2.

A drain guide 86 is also formed in lower chamber 56 when case member 34 is molded. A drain pan 88, whose configuration is shown in FIG. 5, is disposed in the lower chamber 56 as indicated by a phantom line in FIG. 4. A nipple 90 having outlets 92*a* and 92*b* is provided beneath the outlet opening found in drain pan 88. We prefer to attach a drain hose 94 to one of the outlets 92*a* and 92*b* and to place a dead end valve 96 to close the other one of outlets. Drain guide 86 and drain pan 88 are both covered with a heat insulating material 100.

Figure 3:
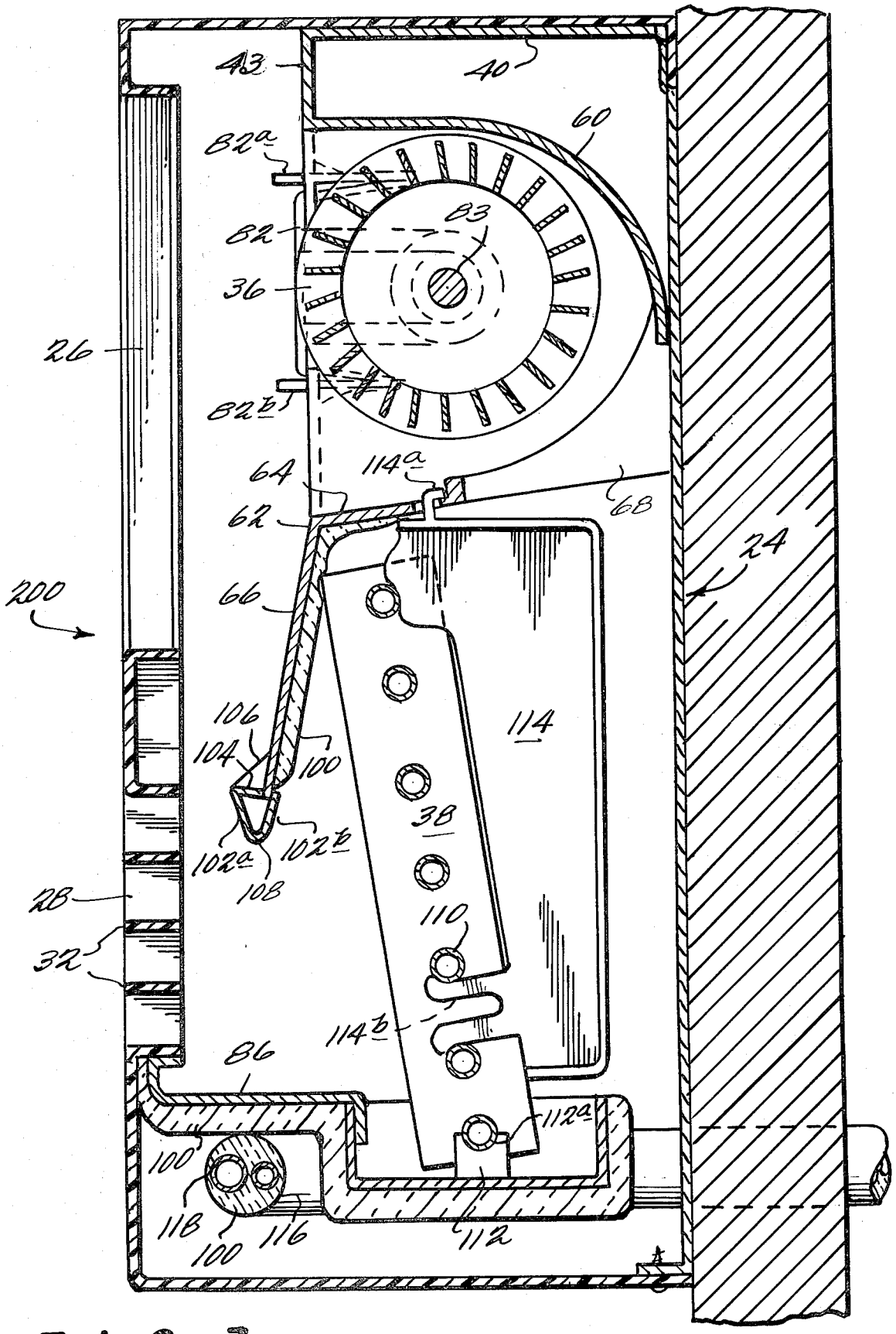
FIG. 3 is a cross-sectional view of the interior unit apparatus shown in FIG. 2.
Figure 6:
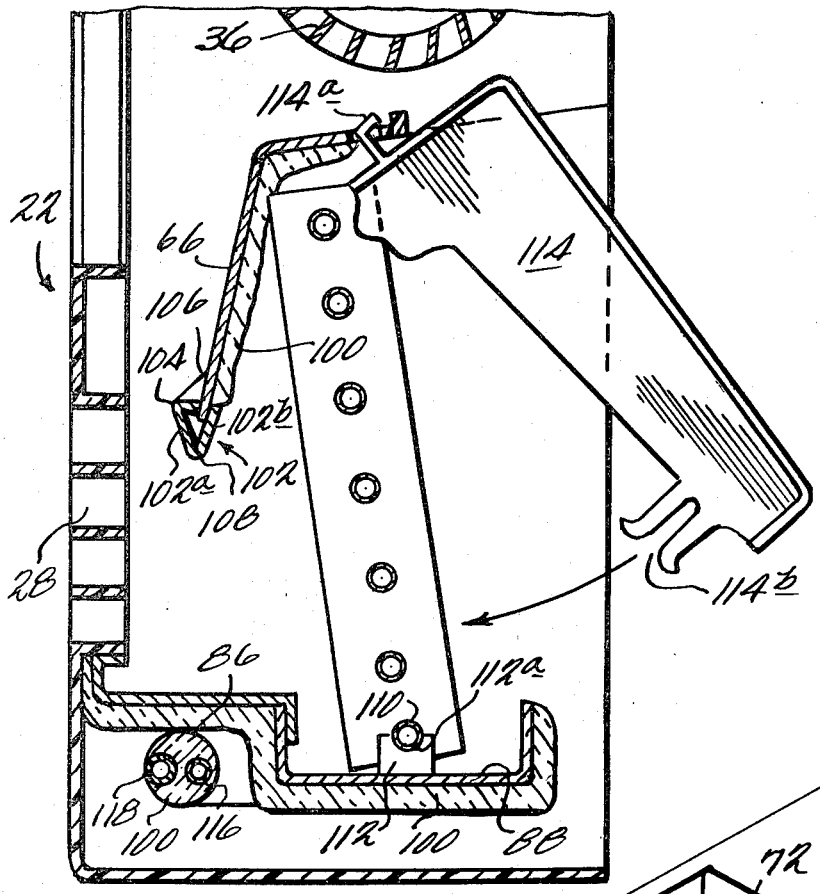
FIG. 6 is a perspective view, partly in section, of a separator and a drain gutter attached to the main body shown in FIG. 4.

Turning now to FIGS. 3 and 6, the drain gutter 102 is formed as a V-shaped member having two opposing sides 102*a* and 102*b* and is attached along the lower or bottom end of flap portion 66. As shown in FIGS. 2 and 3, a plurality of ribs 104 are molded on inner surface of one side 102*a* of the gutter 102, with ribs 104 extending toward the other side 102*b* but are spaced therefrom so that that lower end of flap portion 66 can fit within the space formed therebetween and be held by the inner surface of side 102*b* and ribs 104. A plurality of triangular shaped auxiliary ribs 106 having a number of faces are provided on top of each rib 104. One face on each auxiliary rib 106 is to be parallel to flap portion 66 so as to lie there against and firmly secure drain gutter 102 thereto. The bottom of drain gutter 102 gradually descends or slopes from the midportion toward each end thereof at which an opening 108 is formed for leading drained fluid produced during cooling operation toward and onto drain guide 86 and ultimately into drain pan 88. The inner surface of flap portion 60 is covered with the heat insulating material 100.

Heat exchanger 38 is diagonally supported between flap portion 66 and drain pan 88 in the lower chamber 56. A pipe 110, which is a main part of heat exchanger 38, is used for transporting refrigerant and is elongated at each side of heat exchanger 38. A holder 112, shown in FIG. 6, including a rounded guide 112*a* for receiving the lowest portion of pipe 110 is disposed on each longitudinal end of drain pain 88 so that heat exchanger 38 is supported at its lowest ends. A triangular shaped lever 114 is detachably hinged to the flat portion 64 by a hook 114*a* which can extend through an opening 117 provided on flat portion 64. Each of the openings 117 may be formed after unit body 34 is molded. Each lever 114 has a key 114*b* designed to be inserted between portion of pipe 104 and the hold levers 114 in place. Lever 114 is engaged with different portion of pipe 104 to lean heat exchanger 38 toward flap portion 66 when key 114*b* is inserted as shown in FIG. 6.

As shown in FIG. 2, a tube 116 is connected to one open end of pipe 110 at the lower side of heat exchanger 38 while a tube 118 is connected to the other open end of pipe 110 but at the upper side of heat exchanger. Tube 116 transports the refrigerant to the heat exchanger from the condensor disposed in the exterior unit (not shown) while tube 118 transports refrigerant back to the compressor disposed in the exterior unit to complete the refrigerant cycle. Tube 116 extends upwardly from one open end of pipe 110 to near other open end of pipe 110 along heat exchanger 38. Both of tubes 116 and 118 are extended parallel to drain guide 86 with a curved part having curvature of about 100 mm. These tubes 116 and 118 are wrapped by the heat insulating material 100, which makes an X-crossing with heat exchanger 38. Tubes 116 and 118 also extend beneath drain guide 86 and drain pan 88 until interior unit 20 is equipped on the wall of a room. Open ends of tubes 116 and 118 are prevented from projecting from beneath drain pan 88 and drain guide by nipple 90 as shown in FIG. 5. Having provided adequate curvature, tubes 116 and 118 are easily bent almost 90° around the curved part toward the wall without any damage to tubes 116 and 118 when interior unit 200 is mounted as shown in FIG. 3.

Operation of the interior unit of the air conditioning apparatus described above is as follows. Warm air taken in through upper grill 26 by fan 36 is sent from upper chamber 54 to the lower chamber 56 through passages 69. As the warm air passes through heat exchanger 38, its temperature is decreased and substantially cooled. Cooled air is thereafter blown out from the lower grill 28 as directed by the adjustable blades. Due to the temperature differences between inside and outside of flap portion 66, drains are produced on the outside of that flap portion. Drainage fluid is also produced by heat exchanger 38 and all the draining fluid is collected by drain pan 88 and finally lead out by hose 94.

As mentioned above, a fan casing for an interior unit of a split type air condition is disclosed, which is comprised of a curved rear wall integrally connected to a top wall and side walls and a separator including a flat portion extending generally parallel with the top wall and a flap portion bent downwardly at the front end of the flat portion. Accordingly, adjustment of the relationship between the curved rear wall and the separator for realizing the desired fan efficiency is no longer needed and the same fan efficiency for each unit as manufactured in the factory is guaranteed.

While the invention has been described in connection with what is presently considered to be the most practical and preferred embodiment, it is to be understood that the invention is not to be limited to the disclosed embodiment but on the contrary, is intended to cover various modifications and equivalent arrangements, included within the spirit and scope of the appended claims, which scope is to be accorded the broadest interpretation so as to encompass all such modifications and equivalent structures.

What is claimed is:

1. A casing for an interior unit of an air conditioning apparatus comprising:

a first integrally molded housing having a front panel with a plurality of apertures, a pair of opposite first side walls connected to said front panel and a pair of opposed top and bottom walls connected to said front panel and first said side walls, respectively, a second integrally molded, one piece housing sized to fit inside said first housing comprised of an upper wall and two outer side walls, said upper wall having a front edge, a first vertical separator wall spaced inwardly from one side wall so as to extend substantially parallel with said one side wall, a curved upper rear wall positioned between the other side wall and said first separator wall and spaced below said upper wall, said curved wall having a top and bottom edge, said top edge being connected to the front edge of said upper wall and extending rearwardly and donwardly therefrom, a horizontal separator wall positioned between said other side wall and said first separator wall and beneath said curved rear wall for separating the area within said first housing into separate fan and heat exchange chambers, said horizontal separator including a flat portion having front and rear edges, an upstanding projection extending from said rear edge substantially along the whole length of said rear edge, a flap portion extending downwardly at a predetermined angle from said front edge and terminating along bottom edge and a plurality of spaced apart rib members connected to and extending between the upstanding projection and the bottom edge of said curved upper rear wall, and a rear wall means removably attached to the wall of room for housing said second housing.

2. A casing as in claim 1 wherein each of said outer side walls of said second housing includes a separate, vertically extending interior wall attached to and branched inwardly from each of said outer side walls along a predetermined portion thereof for defining an air space therebetween.

3. A casing as in claim 2, wherein the other one of asid side walls includes means defining a chamber for receiving one end of a fan and wherein said first separator wall includes means defining a chamber for receiving the other end of a fan.

4. A casing as in claim 3 further including drain gutter means for collecting water, said drain gutter means being attached along the bottom edge of said flap portion.

5. A casing as in claim 4 wherein said drain gutter means includes a pair of walls opposing each other and connecting at the bottom thereof, one of said walls having a plurality of mounting projections integrally molded therewith and extending toward said other wall so that a gap is defined therebetween whereby the bottom of edge of said flap portion can fit therein with said drain gutter means being supported between said projections and said other wall.

6. A casing as in claim 4 in which at least one of said projections includes an auxiliary rib provided on said projection, said auxiliary rib having an exposed, face that is substantially parallel with and in contact with the outer surface of said flap portion when said drain gutter is in place on said flap portion.

* * * * *